US005634211A

United States Patent [19]

Chen

[11] Patent Number: 5,634,211

[45] Date of Patent: Jun. 3, 1997

[54] LEG PROTECTOR

[76] Inventor: Mike C. F. Chen, 17, Kung 6 Road, Linkou 2nd Industrial Park, Taipei Hsien, Taiwan

[21] Appl. No.: 610,126

[22] Filed: Feb. 28, 1996

[51] Int. Cl.[6] ..... A41D 13/00

[52] U.S. Cl. ..... 2/22; 2/23; 2/24

[58] Field of Search ..... 2/22, 23, 24, 2, 2/2.5

[56] References Cited

U.S. PATENT DOCUMENTS

| | | | |
|---|---|---|---|
| 1,044,494 | 11/1912 | Clarke | 2/23 |
| 1,294,191 | 2/1919 | Suderlock | 2/2.5 |
| 3,772,704 | 11/1973 | Carbonneau | 2/22 |
| 5,477,558 | 12/1995 | Völker et al. | 2/22 |
| 5,530,966 | 7/1996 | West | 2/2 |

FOREIGN PATENT DOCUMENTS 82206049 5/1993 Taiwan .

OTHER PUBLICATIONS

WO 92/13250; PCT Document; Buchanan; Aug.–1992; 2/2.5.

*Primary Examiner*—Bibhu Mohanty

*Attorney, Agent, or Firm*—Diller, Ramik & Wight, PC

[57] ABSTRACT

The leg protector of the present invention mainly consists of a leg guard, a knee guard, a main guard portion and a padding portion, the main guard portion comprising a plurality of small guard panels which are each provided with a plurality of holes, so that respective guard panels are connected with another by means of a plurality of connecting plates and the buttons provided on the connecting plates.

When the main guard portion is assembled into proper shape and size, the padding portion with corresponding shape and size can be selected with the leg guard, knee guard and main guard portion being laid over suitable regions on the padding portion, and then having rivets driven into the holes on the leg guard and knee guard and those holes on the main guard and the small guard panels which are not occupied by the buttons of the connecting plates, so that the leg guard, knee guard and main guard portion are secured to the padding portion.

6 Claims, 4 Drawing Sheets

LEG PROTECTOR

BACKGROUND OF THE INVENTION

The present invention relates to a leg protector and, in particular, to such a leg protector for use by baseball or softball catchers or umpires.

Conventional leg protectors, as shown in FIGS. 6 and 7, comprise a padding portion 11 being provided with a leg guard 2, a knee guard 3 and a shin guard 66 secured thereon by means of a plurality of rivets 15. The leg protector is further provided with a plurality of fastening straps 20 and buckles 21 for fitting over the leg of the user. A protecting ear 12 is protruded from the left and the right side of the bottom end of the padding portion 11 for protecting the ankle of the user. The padding portion 11 is formed of foam and the leg guard 2, knee guard 3 and shin guard 66 are injection molded from rigid plastic material. While such conventional leg protectors may protect the legs of the user from being hurt under the strong impact of the ball, the shin guards are injection molded so that their lengths and widths are not readily adjustable to fit the physical builds of the users. Although the shin guards can be made in different sizes, yet such will add difficulties to the manufacturing and assembling processes, and the users may not easily choose the right size that suits best and have to pay more to buy the protectors because of the increased manufacturing cost.

Therefore, there has been a continued need for providing a leg protector which can be easily manufactured and assembled and which can be easily adjusted in length and width to fit various physical builds of the users.

SUMMARY OF THE INVENTION

The leg protector of the present invention mainly consists of a leg guard, a knee guard, a main guard portion and a padding portion, the main guard portion comprising a plurality of small guard panels which are each provided with a plurality of holes, so that respective guard panels are connected with another by means of a plurality of connecting plates and the buttons provided on the connecting plates.

When the main guard portion is assembled into proper shape and size, the padding portion with corresponding shape and size can be selected with the leg guard, knee guard and main guard portion being laid over suitable regions on the padding portion, and then having rivets driven into the holes on the leg guard and knee guard and those holes on the main guard and the small guard panels which are not occupied by the buttons of the connecting plates, so that the leg guard, knee guard and main guard portion are secured to the padding portion.

The leg guard, knee guard, and small guard panels are all injection molded from rigid and impact-resistant plastic material. The connecting plates are normally injection molded from soft and flexible plastic material. The padding portion is made of foam, one side thereof being provided with a plurality of fastening straps which can be fastened correspondingly into the plurality of buckles provided on the other side to facilitate the wearing of the user.

The leg protector of the present invention is light in weight due to the fact that the leg guard, knee guard and small guard panels are formed of rigid and impact-resistant plastic material and the padding portion is made of foam. When being hit by a fast flying ball, the impact force is first offset and dispersed by the guard panels, then transmitted into the foam of the padding portion, and finally absorbed. The shape and size of the main guard portion can be varied by using small guard panels different in number and size, such that leg protectors in specifications of different shapes and sizes can be assembled for the users, and that the leg protector can even be worn so as to wrap around the whole leg and shin portion.

Accordingly, an object of the present invention is to provide a leg protector which is light in weight and which can effectively offset, disperse and absorb the impact force of the ball hitting with strong force.

Another object of the present invention is to provide a leg protector which can be manufactured in different lengths.

A further object of the present invention is to provide a leg protector which can be adjusted in widths.

BRIEF DESCRIPTION OF THE DRAWINGS

The above and other objects, features, and advantages of the present invention will become apparent from the following detailed description of a preferred embodiment thereof in conjunction of the accompanying drawings, in which.

DETAILED DESCRIPTION OF THE INVENTION

Referring to FIGS. 1 to 5, an embodiment of the present invention will be described in detail.

Figure 1:
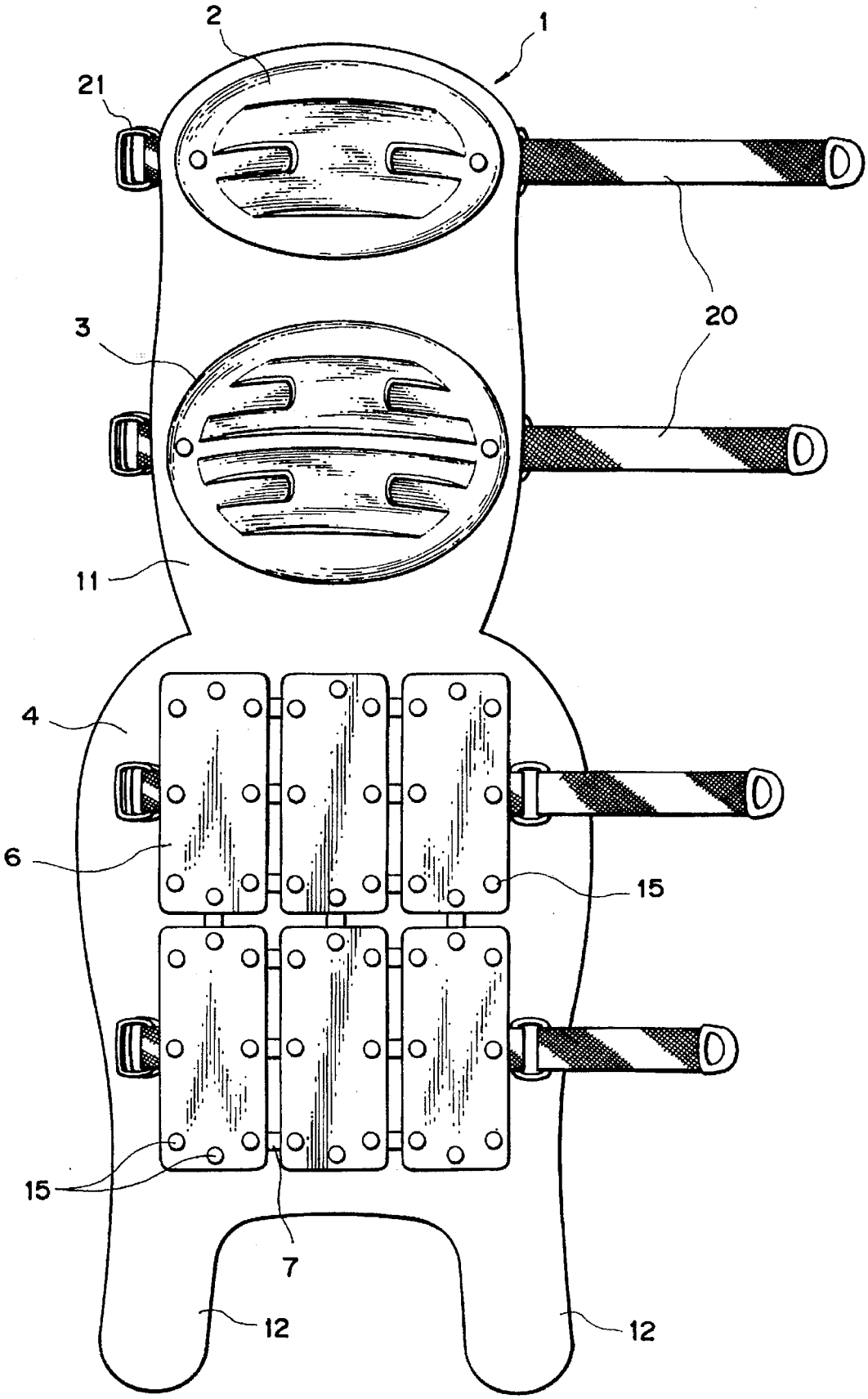
FIG. 1 is a front elevation view of the leg protector of the present invention.

Referring to FIG. 1, the leg protector of the present invention comprises a leg guard 2, a knee guard 3, a main guard portion 4, and a padding portion 11. The main guard portion 4 consists of a plurality of small guard panels 6 connected with one another by means of a plurality of connecting plates 7 (as shown in FIG. 1). The leg guard 2, knee guard 3, and small guard panels 6 are all provided with holes 8, and are injection molded from rigid and impact-resistant plastic material. The connecting plates 7 are injection molded from soft and flexible plastic material.

Figure 2:
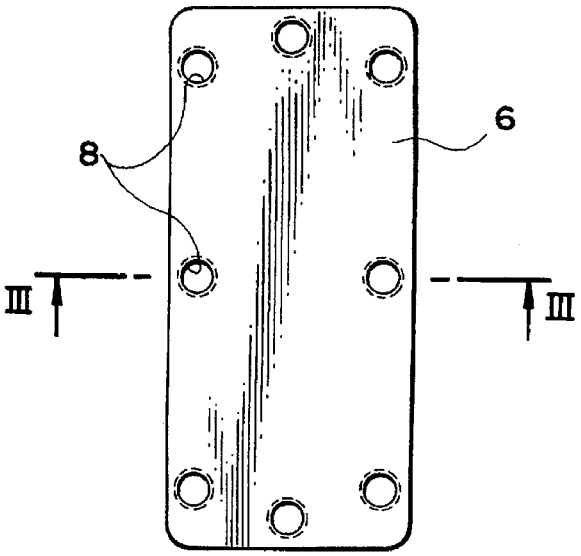
FIG. 2 is a front elevation view of the small guard panel of the present invention.
Figure 3:
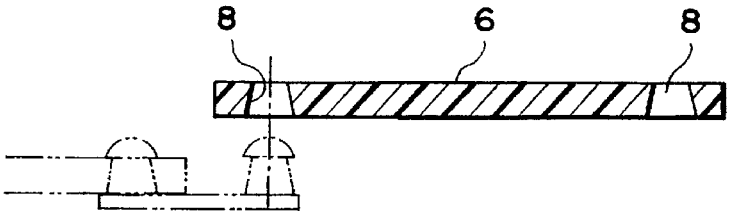
FIG. 3 is an enlarged cross section view of the small guard taken along line III—III in FIG. 2.

The small guard panels 6 may be rectangular in shape, being each provided with at least holes 8 at both ends as desired. If the small guard panels 6 are relatively long, they can be further provided at the intermediate section with a plurality of holes 8 (as shown in FIG. 2). In the case where both ends are each provided with three holes 8, when making the connections, one of the three holes 8 at one end is used for connection in the major axial direction, and the other two holes 8 are used for connection in the minor axial direction, with all connections being made with other small guard panels 6.

The leg guard 2, knee guard 3, and small guard panels may all be slightly curved or bent in accordance with the curvature of the human body.

In the embodiment shown in FIG. 1, although the all the small guard panels 6 of rectangular shape and in the same size are used, they can be of varying shapes and sizes.

In fact, the shapes and sizes can be further varied without limitation to the shapes and sizes which have been used in the assembly of the embodiment. For example, they can be rectangular relatively short in length, being provided with a number of holes only at the ends but no hole in the intermediate section, or they can be in the shape of a diamond or a square. In addition, different shapes can be alternatively used. For example, rectangular small guard panels can be used alternatively with square ones. The main guard portion 4 can be assembled in different shapes and sizes by using a different number of the small guard panels 6.

Figure 4:
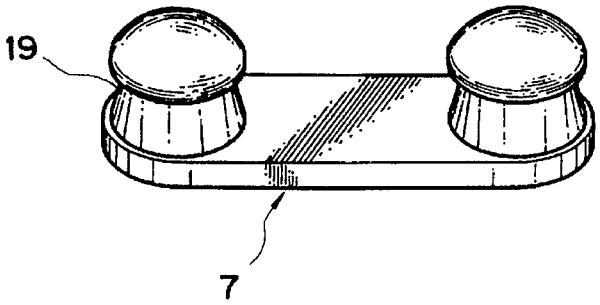
FIG. 4 is a perspective view of the connecting plate.

The connecting plates 7 are each provided at both ends with buttons 19 (referring to FIG. 4). The buttons 19 are in the shape of a mushroom, while the holes 8 of the small guard panels 6 have a cross section in an inversely tapered shape, so that the buttons 19 can be easily snapped into the holes 8 for better fastening effect (referring to FIGS. 3 and 4).

After the main guard portion 4 is assembled into suitable shape and size, the padding portion 11 of suitable shape and size can be selected and the leg guard 2, knee guard 3, and main guard portion 4 are laid over the padding portion 11 and then rivets 15 are driven into the holes 8 of the leg guard 2 and the knee guard 3 and into those holes 8 on the small guard panels 6 in the main guard portion 4 which are not occupied by the buttons 19 of the connecting plates 7, such that the leg guard 2, knee guard 3, and main guard portion 4 are secured onto the padding portion 11. The padding portion 11 is formed of foam being provided on one side with a plurality of fastening straps 20 which can be fastened correspondingly into the plurality of buckles 21 provided on the other side thereof to facilitate the wearing of the user. A protecting ear 12 is formed at each of the left and right ends extending down from the bottom side for protecting the ankle (referring to FIG. 1).

Figure 5:
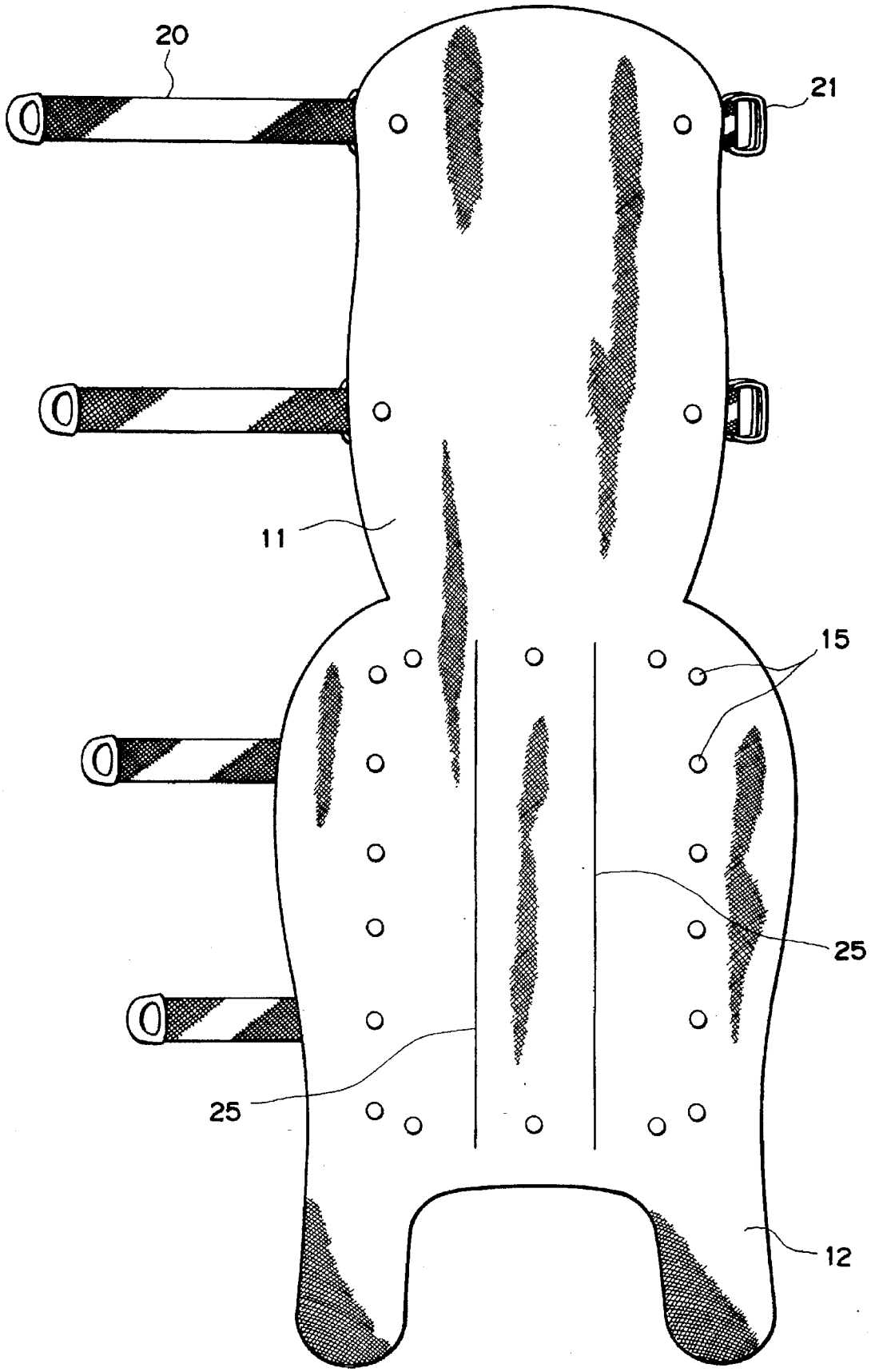
FIG. 5 is a rear view of the of the leg protector of the present invention.
Figure 7:
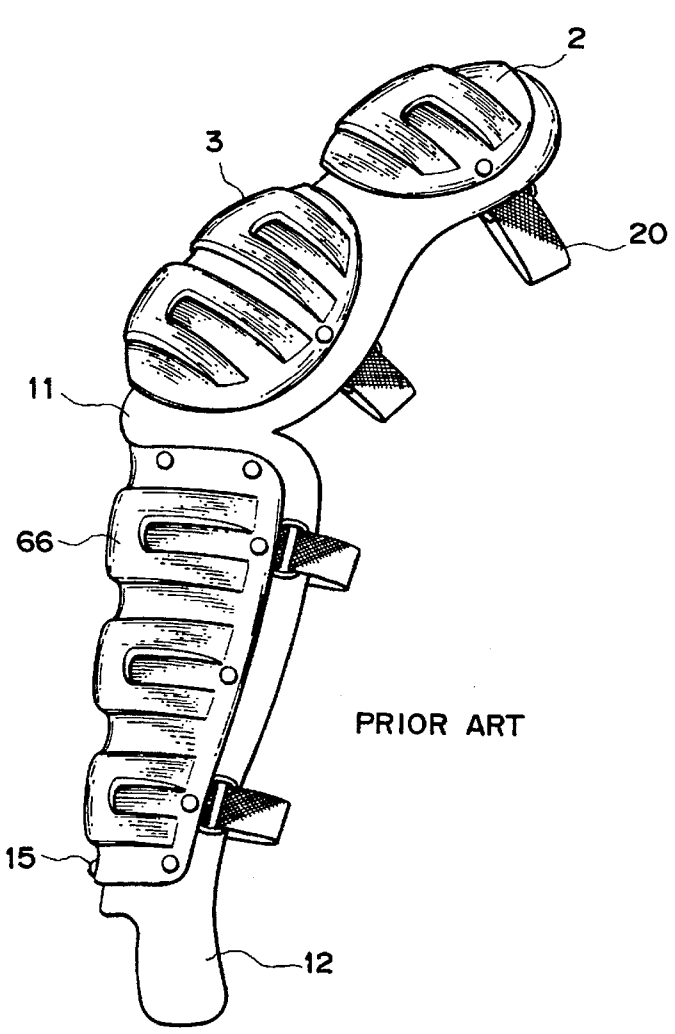
FIG. 7 is a side elevation view of the conventional leg protector.
Figure 6:
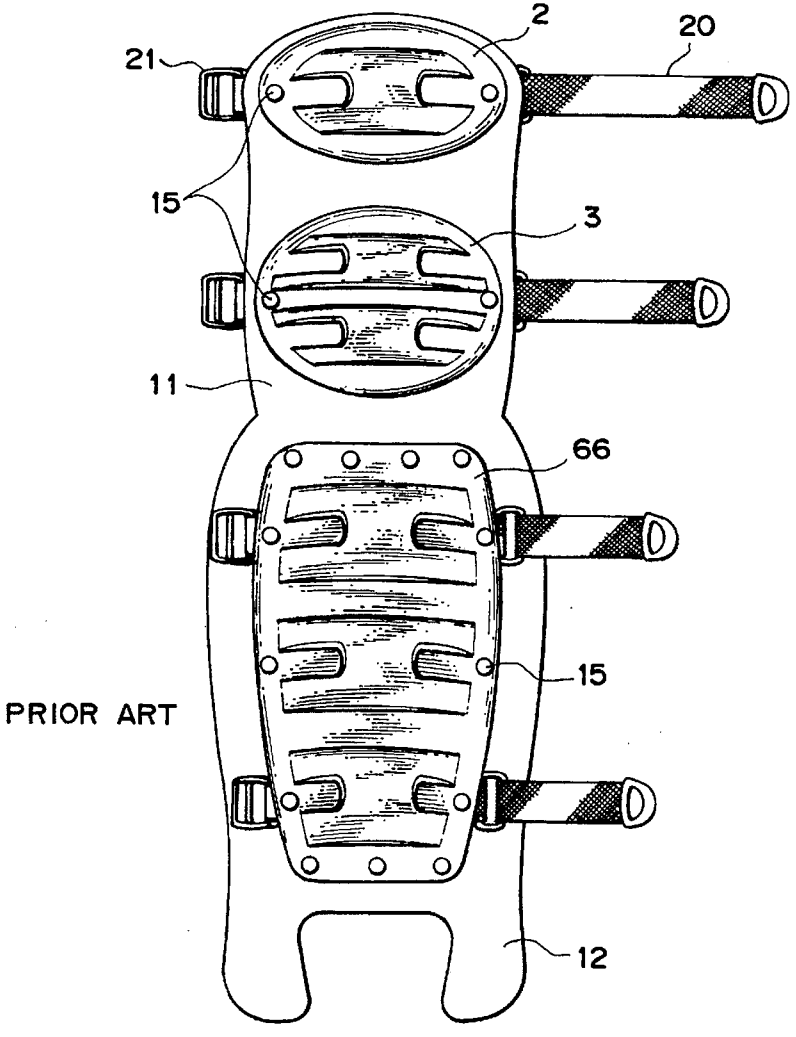
FIG. 6 is a front elevation view of a conventional leg protector.

A plurality of seams 25 (as shown in FIG. 5) in the long major direction may be provided on the padding portion 11 to facilitate bending and wrapping around the leg of the user.

In the above embodiment, although the leg guard 2, knee guard 3 and main guard portion 4 are used, respectively, for protecting the leg, knee, and shin of the user, it is possible that only the knee guard 3 and main guard portion 4 are used as desired for the convenience of use.

The above embodiment shown in FIG. 1 is described for illustrative purpose only and not in a limiting sense.

Modifications and variations (such as the shapes, sizes, and number of the small guard panels) as well as alternative embodiments can be made by those skilled in the art according to the spirit of the present invention and the appended claims. It is intended that all such modifications, variations and embodiments are considered as being within the scope of the present invention.

I claim:

1. A leg protector comprising a knee guard for protecting the knee, a main guard portion for protecting the shin, and a padding portion, characterized in that:

the main guard portion comprises a plurality of small guard panels connected by a plurality of connecting plates, said small guard panels being each provided at both ends with a plurality of holes for connection, said connecting plates being each provided at both ends with a button for fastening into the holes on the small guard panels connecting said plurality of connecting plates to said plurality of small guard panels, said knee guard and said main guard portion laid over said padding portion of suitable shape and size and secured to said padding portion by having a plurality of rivets driven into a plurality of holes provided in the knee guard and the small guard panels.

2. The leg protector according to claim 1, wherein said small guard panels are rectangular in shape and have a plurality of holes, at least one of the holes being used for connection in the major axial direction and two other holes for connection in the minor axial direction.

3. The leg protector according to claim 1, wherein said buttons on the connecting plates are in the shape of a mushroom with the holes on the small guard panels having a cross section in an inversely tapered shape such that the buttons can be fastened into the holes.

4. The leg protector according to claim 1, wherein said small guard panels are injection molded from rigid and impact-resistant plastic material and said connecting plates are injection molded from soft and flexible plastic material.

5. The leg protector according to claim 1, wherein said lower padding portion is formed of foam.

6. The leg protector according to claim 1, wherein a plurality of seams in the major axial direction may be provided on the padding portion to facilitate bending and wrapping around the leg of the user.

* * * * *